US006402138B1

(12) United States Patent
Möhringer et al.

(10) Patent No.: US 6,402,138 B1
(45) Date of Patent: Jun. 11, 2002

(54) STOP ASSEMBLY FOR A SHEET PILE EDGE

(75) Inventors: Markus Möhringer, Mannheim; Jochen Renner, Edingen, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/611,771

(22) Filed: Jul. 7, 2000

(30) Foreign Application Priority Data

Jul. 7, 1999 (DE) ..... 199 31 200

(51) Int. Cl.[7] ..... B65H 31/20

(52) U.S. Cl. ..... 271/223; 271/224

(58) Field of Search ..... 271/220, 223, 271/224; 414/788.9

(56) References Cited

U.S. PATENT DOCUMENTS 3,051,479 A * 8/1962 Gore
4,097,042 A * 6/1978 Rozga ..... 271/171
4,500,243 A * 2/1985 Ward, Jr. et al. ..... 271/224 X

FOREIGN PATENT DOCUMENTS

DE 667 527 10/1938
DE 298 01 061 U1 4/1998

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

An assembly of at least one stop for a sheet pile edge in a sheet-processing machine, the stop being constructed as a rotatably mounted, adjustable-format roller, comprising a vertically pivotable link whereon the roller is disposed so as to be adjustable in height.

7 Claims, 5 Drawing Sheets

STOP ASSEMBLY FOR A SHEET PILE EDGE

BACKGROUND OF THE INVENTION

Field of the Invention

The invention relates to a stop assembly for a sheet pile edge in a sheet-processing machine and, more particularly, to such a stop assembly that is constructed as a rotatably mounted, adjustable-format roller.

For the purpose of separating sheets from the top of a sheet pile, suction elements are used which are assisted by blower or blast devices, strippers and a sensing element that generates a signal for tracking the pile. The pile, which is offset laterally a predefined target course, is seated centrally in relation to the sheet-processing machine, in particular, a printing machine. In order to achieve as constant a target course as possible, as well as sheet leading edges running in parallel with the front lays and a uniform sheet arrival time, the pile or at least the upper sheets of the pile should be aligned as accurately as possible in the circumferential and lateral directions before being separated. Such pre-stacking or pre-pile formation activities are generally performed manually. In this regard, a stop that is adjustable to the format serves to guide the pile in the upper region thereof.

A stop of this type is disclosed, for example, in German Patent 667 527. The stop includes one or more rollers which, in accordance with the format, is settable against a lateral edge of the sheet pile.

The rollers described in this German patent are not mounted so that the height thereof is adjustable. Exact positioning is therefore not assured.

SUMMARY OF THE INVENTION

It is accordingly an object of the invention to provide a stop for a sheet pile edge by which the pile is aligned, at least in the upper region of the pile.

With the foregoing and other objects in view, there is provided, in accordance with the invention, an assembly of at least one stop for a sheet pile edge in a sheet-processing machine, the stop being constructed as a rotatably mounted, adjustable-format roller, comprising a vertically pivotable link whereon the roller is disposed so as to be adjustable in height.

In accordance with another feature of the invention, the assembly includes another stop constructed as a roller for acting with the first-mentioned roller upon a trailing edge of the sheet pile.

In accordance with a further feature of the invention, the assembly includes two additional stops constructed as rollers, respectively, for acting upon lateral edges of the sheet pile.

In accordance with an added feature of the invention, the assembly includes further stops constructed as rollers, the one stop and the further stops being arranged so that they are displaceable and lockable along trailing and lateral edges of the sheet pile.

In accordance with an additional feature of the invention, the assembly includes an additional stop assigned to the one roller.

In accordance with yet another feature of the invention, the additional stop is pivotally mounted.

In accordance with yet a further feature of the invention, the assembly includes at least two additional stops assigned to the one and the further rollers.

In accordance with a concomitant feature of the invention, the additional stops are pivotally mounted.

It is an advantage of the invention that the stop according to the invention is aligned with the upper sheets in the circumferential direction. Due to this measure, it is also possible to process sheet piles which are not aligned absolutely exactly in the circumferential direction, i.e., in the sheet transport direction.

A further advantage resides in the arrangement of the stops according to the invention in the upper side or lateral region of the sheet pile; due to this measure, the sheet pile is brought laterally into the provided position.

The stops according to the invention are constructed as rotatably mounted rollers, both in the rear or trailing edge region and in the lateral edge region.

Mounting the rotatable roller so that it is pivotable permits the roller to execute a virtually vertical deflection movement. By this measure, it is possible to bring up a pile board so close to the separating or singling elements that even the last sheets of a sheet pile can be processed. In a further advantageous configuration of the invention, each alignment roller has an auxiliary or additional stop assigned thereto which, when the roller makes contact with the pile board, performs the alignment function.

Other features which are considered as characteristic for the invention are set forth in the appended claims.

Although the invention is illustrated and described herein as embodied in a stop for a sheet stack edge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
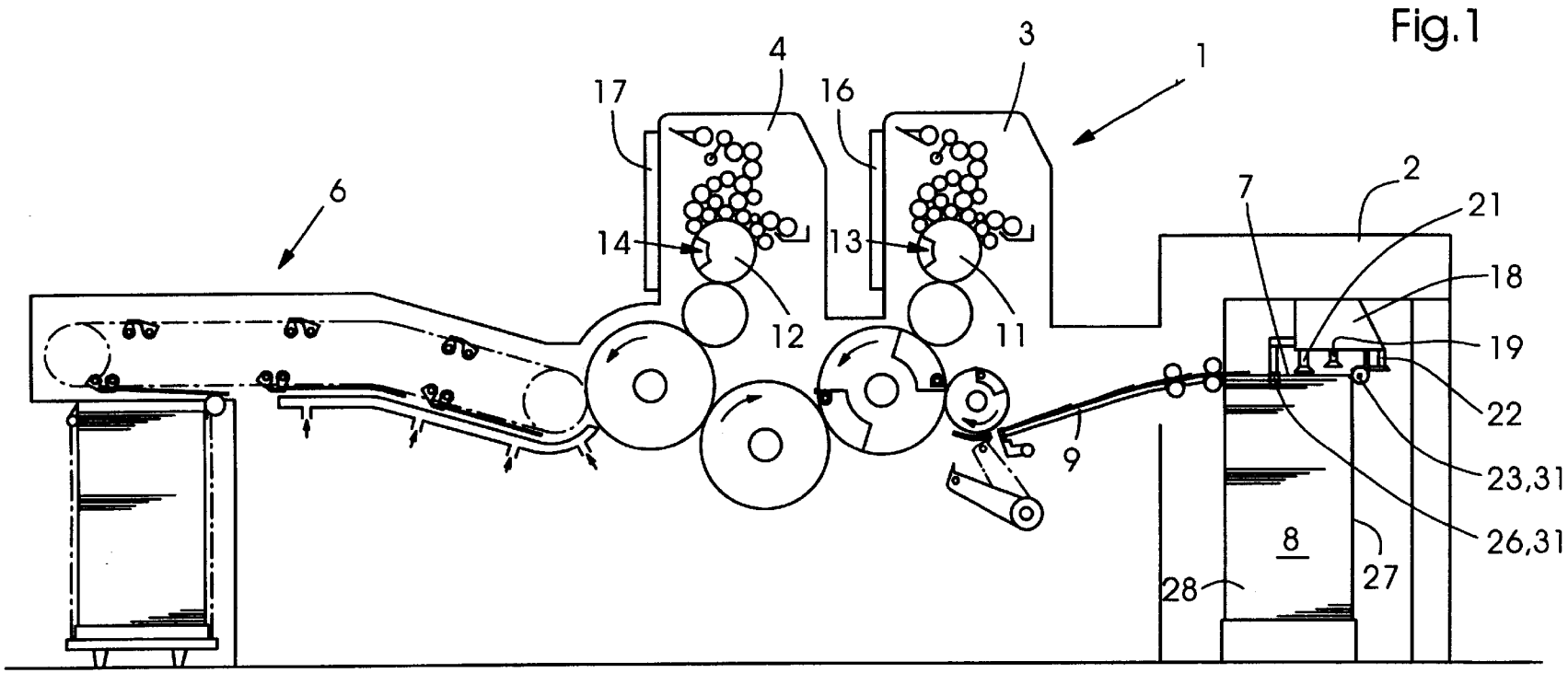
FIG. 1 is a diagrammatic side elevational view of a sheet-fed rotary printing machine incorporating the stop for the sheet pile edge according to the invention.
Figure 2:
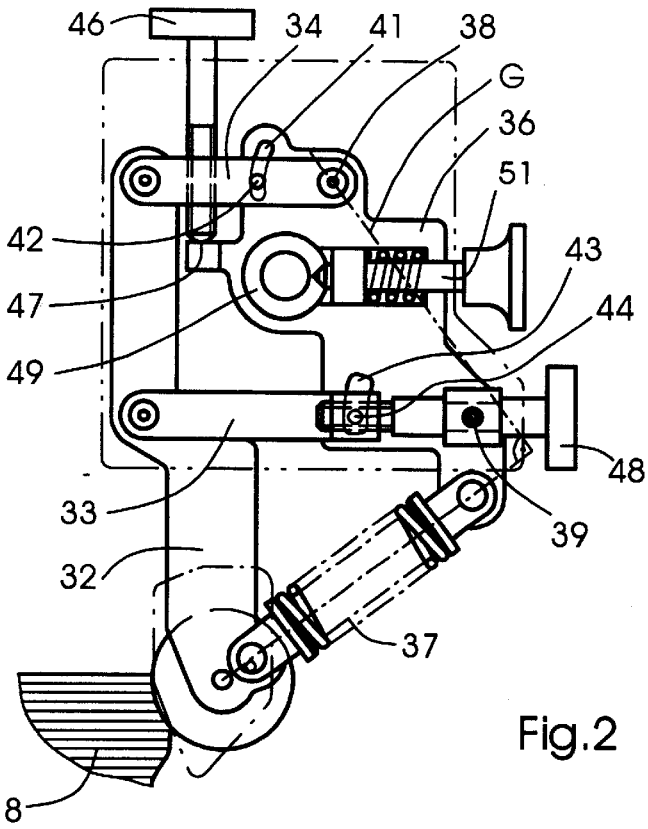
FIG. 2 is a much-enlarged fragmentary side elevational view of FIG. 1 showing diagrammatically a sheet alignment roller according to the invention.
Figure 3:
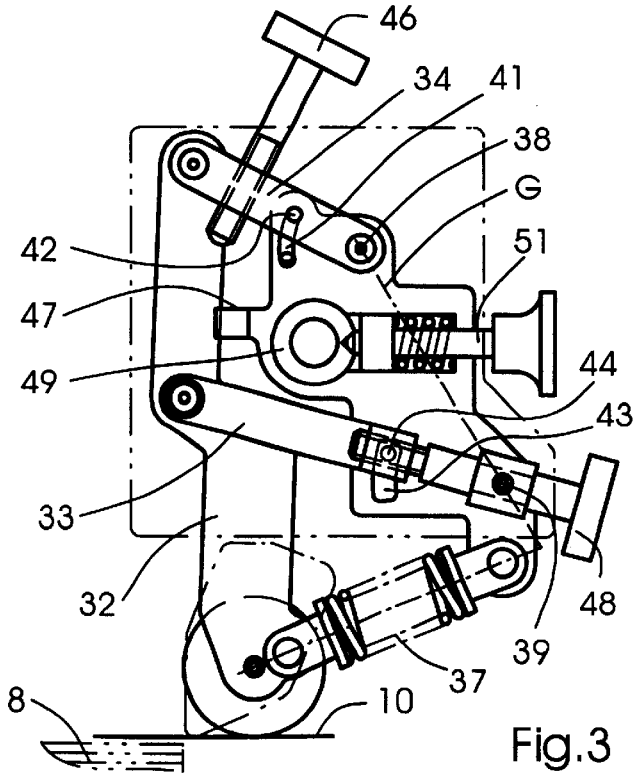
FIG. 3 is a view like that of FIG. 2 showing the sheet alignment roller in another operating phase thereof wherein it is in a latched position.
Figure 4:
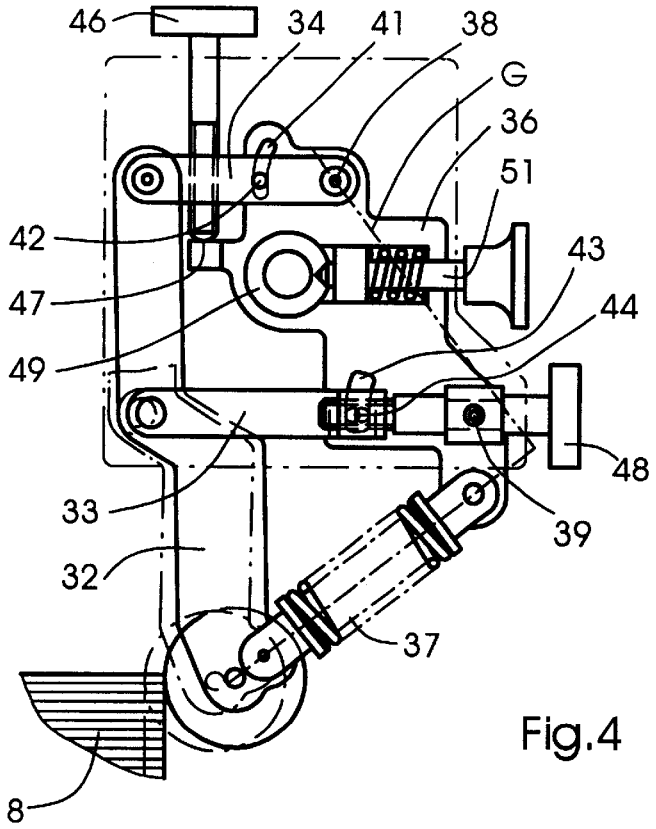
FIG. 4 is a view like those of FIG. 2 and 3 showing the sheet alignment roller in an operating phase wherein it is adjusted in accordance with the format.

Referring now to the figures of the drawings and, first, particularly to FIG. 1 thereof, there is shown therein a rotary printing machine, for example a sheet-processing printing machine 1 having a sheet feeder 2, at least one printing unit 3 and 4 and a delivery 6. Sheets 7 are removed from a sheet pile 8 and are fed singly or in an imbricated or overlapping manner over a feed table to the printing units 3 and 4, which are provided with respective plate cylinders 11 and 12. Each of the plate cylinders 11 and 12 has a respective device 13, 14 for affixing flexible printing plates. In addition, each plate cylinder 11; 12 has a respective device 16; 17 assigned thereto for semiautomatically or fully automatically changing printing plates.

The sheet pile 8 lies on a controllably liftable pile board 10. The sheets 7 are removed from the top of the sheet pile 8 by a so-called suction head 18 which, inter alia, has a number of suckers 19 and 21 for separating the sheets 7. In addition, blower or blast devices 22 for loosening the upper sheet layers, and sensing elements for tracking the pile 8 are provided. In order to align the sheet pile 8, in particular the upper sheets 7 of the sheet pile 8, stops 23 to 26 (note FIG. 8) are provided. In this regard, the stops 23 and 24 engage with a rear or trailing edge 27 of the sheet pile 8, and the stops 25 and 26, respectively, engage with a side edge 28 and 29 of the sheet pile 8. The stops 23 to 26 are of mutually identical construction and, respectively, have a rotatably mounted roller 31, which cooperates directly with one of the sheet edges 27, 28 and 29, respectively.

The roller 31 is situated at the end of a nearly vertically pivotable link or coupler 32, as shown in FIGS. 2 to 7. The link 32 is attached to a holder 36 via a lower lever 33 and an upper lever 34 disposed parallel thereto.

Located at the lower part of the holder 36 and at the lower end of the link 32 is a compression spring 37. A force action line of the compression spring 37 extends perpendicularly to a straight line G passing through the attachment points 38 and 39 of the levers 33 and 34, respectively.

The holder 36 is formed with a first stop groove 41 for a guide pin 42 provided on the lever 34. In addition, the holder 36 is formed with a second stop groove 43 for a guide pin 44 provided on the lever 33.

A setscrew 46 for adjusting the height of the roller 31 is screwed into the upper lever 34 and, at the tip thereof, is supported on a stop 47 formed on the holder 36.

The lower lever 33 has a bipartite construction, the two parts thereof being joined by a screw connection, so that the length of the lever 33 is variable. One part of the lever 33 is constructed as a setscrew 48 and serves for adapting the roller 31 to the format.

The holder 36 itself is displaceably mounted on a carrier 49 and is fixable thereon by a latching bolt 51.

Figure 8:
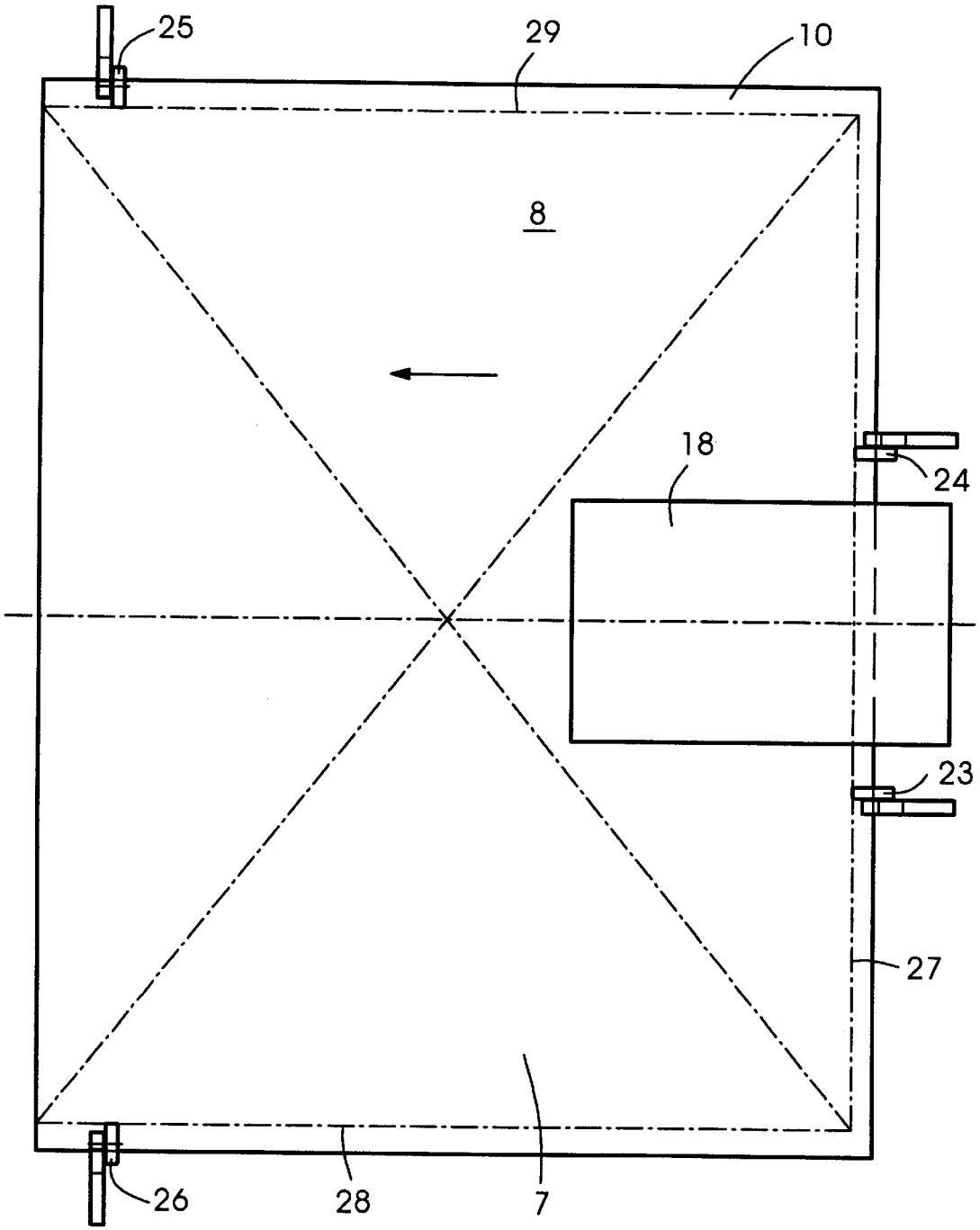
FIG. 8 is a much-enlarged fragmentary plan view of FIG. 1 diagrammatically showing the sheet pile.

FIG. 8 shows an arrangement of the stops 23 to 26 constructed as rollers 31.

Figure 5:
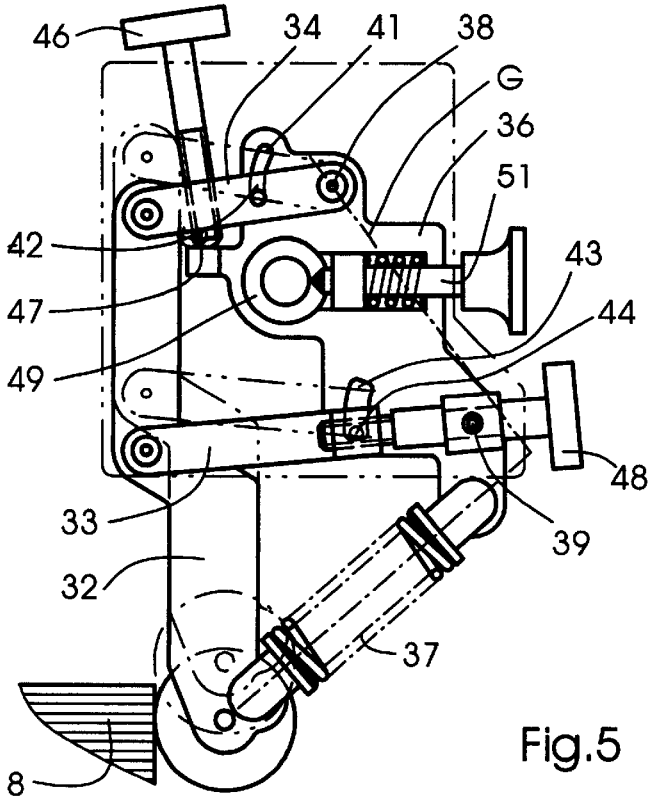
FIG. 5 is a view like those of FIGS. 2 to 4 showing the sheet alignment roller in a further operating phase wherein the height thereof is adjusted.
Figure 6:
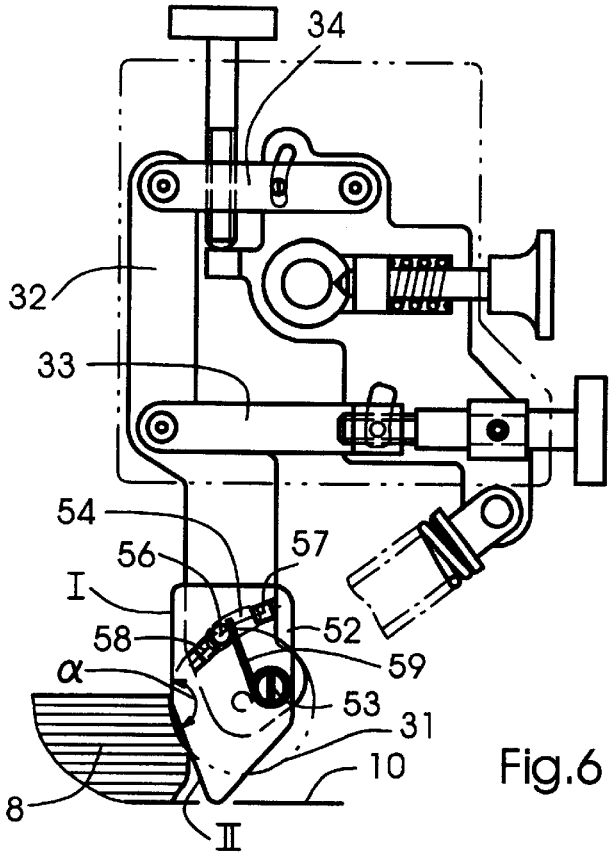
FIG. 6 is a view like those of FIGS. 2 to 5 shows the sheet alignment roller with an additional stop in a latched position.

In a further configuration, provision can be made, according to FIGS. 5 and 6, for an additional stop 52, which is mounted at the lower end of the link 32 so that it is pivotable about a pivot 53. The additional stop 52 has a stop groove 54 for a stop pin 56 provided on the link 32. The length of the stop groove 54 can be adjusted by two setscrews 57 and 58. A return or restoring spring 59 is arranged on the additional stop 52, in the vicinity of the pivot 53, and presses against the stop pin 56 on the link 32.

Figure 7:
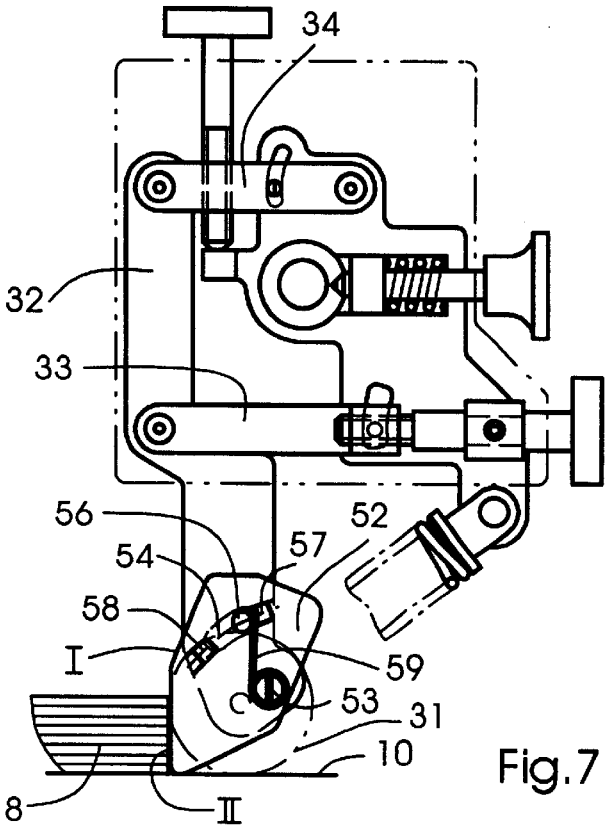
FIG. 7 is a view like those of FIGS. 2 to 6 showing the sheet alignment roller with the additional stop in working position.

The additional stop 52 is disposed parallel to the roller 31 on the link 32, and extends downwardly beyond the periphery of the roller 31, as viewed in FIGS. 6 and 7.

The additional stop 52 has two stop faces I, II, defining an angle a therebetween, for the sheet pile rear or trailing edge 27.

In a working position of the roller 31, the stop face I is vertical and thus parallel to the pile rear edge 27. In a working position of the additional stop 52, the stop face II is vertical in relation to the sheet pile rear edge 27, in order to align the latter.

The stops 23 to 26, formed as rollers 31, align the sheet pile 8, in particular in the upper region thereof, wherein the sheets 7 are loosened by blower or air blast devices 22.

If the sheet pile 8 to be processed is being reduced to the end thereof, the rollers 31 come into contact with the pile board 10 whereon the sheet pile 8 rests. Due to this measure, the alignment function of the roller 31 is stopped. However, in order for the rest of the pile also to be aligned well, provision is made for each roller 31 to have an additional stop 52 assigned thereto which, due to the contact thereof with the pile board 10, is pivoted counter to the force of the return spring 59 so that the stop face II is vertical and cooperates with the respective sheet pile edge 27 to 29 in such a way that the respective edge is aligned.

We claim:

1. A stop assembly for a sheet pile in a sheet-processing machine, comprising:

a plurality of stops each having a rotatably mounted roller, and a vertically pivotable link whereon said roller is disposed so as to be adjustable in height, at least one of said plurality of stops being disposed for acting upon the trailing edge of the sheet pile.

2. A stop assembly for a sheet pile in a sheet-processing machine, comprising:

a plurality of stops each having a rotatably mounted roller, and a vertically pivotable link whereon said roller is disposed so as to be adjustable in height, wherein the sheet pile has lateral edges and said plurality of stops include two additional stops constructed as rollers, respectively, for acting upon the lateral edges of the sheet pile.

3. A stop assembly for a sheet pile in a sheet-processing machine, comprising:

a plurality of stops each having a rotatably mounted roller, and a vertically pivotable link whereon said roller is disposed so as to be adjustable in height, wherein the sheet pile has a trailing edge and lateral edges and said plurality of stops are arranged so that they are displaceable and lockable along the trailing and lateral edges of the sheet pile.

4. The assembly according to claim 3, including at least two additional stops assigned to said plurality of stops.

5. The assembly according to claim 4, wherein said at least two additional stops are pivotally mounted.

6. A stop assembly for a sheet pile in a sheet-processing machine, comprising:

a plurality of stops each having a rotatably mounted roller, and a vertically pivotable link whereon said roller is disposed so as to be adjustable in height, wherein each of said plurality of stops includs an additional stop assigned to said roller.

7. The assembly according to claim 6, wherein said additional stop is pivotally mounted.

* * * * *